US006990833B2

(12) United States Patent
Smith

(10) Patent No.: US 6,990,833 B2
(45) Date of Patent: Jan. 31, 2006

(54) FACETED CIRCULAR CUT DIAMOND

(76) Inventor: Allen L. Smith, P.O. Box 3884 21 Stuyvesant Plz., Albany, NY (US) 12203

( * ) Notice: Subject to any disclaimer, the term of this patent is extended or adjusted under 35 U.S.C. 154(b) by 0 days.

(21) Appl. No.: 10/252,147

(22) Filed: Sep. 23, 2002

(65) Prior Publication Data

US 2004/0055333 A1 Mar. 25, 2004

(51) Int. Cl.
*A44C 17/00* (2006.01)

(52) U.S. Cl. ..... 63/32; D11/89; D11/90

(58) Field of Classification Search ..... 63/1.11, 63/15, 15.1–15.8, 20, 26–32; D11/89, 90
See application file for complete search history.

(56) References Cited

U.S. PATENT DOCUMENTS

| | | | | |
|---|---|---|---|---|
| 693,084 | A * | 2/1902 | Townsend | 63/32 |
| 809,531 | A * | 1/1906 | Schenck | 63/32 |
| D204,199 | S * | 3/1966 | Westreich | D11/90 |
| 4,056,952 | A * | 11/1977 | Okuda | 63/32 |
| 4,306,427 | A * | 12/1981 | Urban | 63/32 |
| D439,196 | S * | 3/2001 | Tolkowsky | D11/90 |
| D451,427 | S * | 12/2001 | Tolkowsky | D11/90 |
| 6,397,832 | B1 * | 6/2002 | Shuto | 125/30.01 |
| 6,405,562 | B1 * | 6/2002 | Zimet et al. | 63/32 |
| D474,995 | S * | 5/2003 | Mehta | D11/90 |
| D476,257 | S * | 6/2003 | Mehta | D11/90 |
| 6,604,382 | B2 * | 8/2003 | Shuto | 63/32 |
| 2003/0010058 | A1 * | 1/2003 | Wueste | |
| 2003/0043078 | A1 * | 3/2003 | Kawabuchi et al. | |
| 2003/0192346 | A1 * | 10/2003 | Samuels | |

FOREIGN PATENT DOCUMENTS

| | | | |
|---|---|---|---|
| JP | 2001204519 | A * | 7/2001 |
| JP | 2002136314 | A * | 5/2002 |
| WO | WO 03/103434 | A2 * | 12/2003 |

* cited by examiner

*Primary Examiner*—Robert J. Sandy
*Assistant Examiner*—Ruth C. Rodriguez
(74) *Attorney, Agent, or Firm*—Owens & McQuade PLLC; Thomas M. Owens, Esq.

(57) ABSTRACT

A circular cut diamond, with appropriate dimensions, to greatly enhance the brilliancy, scintillation, and dispersion of a circular cut diamond and to produce a larger-looking diamond per unit volume as compared to the current standard Ideal Cut.

7 Claims, 5 Drawing Sheets

FACETED CIRCULAR CUT DIAMOND

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to a new and novel cut for a diamond.

2. Background Information

Gemstones, especially diamonds, have various characteristics that distinguish them from other gemstones. One characteristic is brilliance, which can be further categorized into external and internal. External brilliance generally refers to the amount of light that impinges on the top of the stone and reflects back, rather than refracted inward. Internal brilliance is determined by the light rays that enter the crown or table and reflected off the base of pavilion facets and back out through the top or crown as undispersed light.

Another characteristic is dispersion, also known as fire, which is a measure of how much the white light is broken up into the spectral colors. Dispersion is maximized when a ray of light is reflected totally from the base facets and strikes the crown facets at the greatest possible angle.

Another characteristic is scintillation, which is an indication of the different light patterns obtained when the stone is moved under light. It is the quantity of flashes observed from the gemstone when at least one of the gemstone, light source or observer moves.

Diamond cutting, prior to the end of the twentieth century was principally done for weight conservation from the diamond rough. Little was known about how light interacts with an optically dense and transparent geometric structure such as a diamond.

In approximately 1920, Marcel Tolkowski used basic geometry to trace a beam of light as it entered and exited a two-dimensional round cut diamond with 58 facets. In doing so, Tolkowski was probably the first person to make use of the prismatic effect of a diamond when cut to pre-determined angles and proportions. The crown and table facets were used to allow light to enter the stone. The base facets, below the girdle, act like mirrors reflecting the light entering the stone back out through the top of the stone.

As discussed, diamond cutters have historically attempted optimum results by a blending of portions and angles with a primary purpose being weight retention of the diamond. Tolkowski's model is still used today as the conventional cutting angles and proportions and is known as the Tolkowski "Ideal Cut." Diamond cutters using the Ideal Cut attempt to maximize scintillation, brilliancy, and dispersion characteristics across the crown of the diamond while maximizing weight retention of the gemstone.

Tolkowski did not fully comprehend light interacting with a three dimension object—largely due to the fact that he lacked the computer resources of today. Therefore, it is an object of the present invention, by providing appropriate dimensions, to greatly enhance the brilliancy, scintillation, and dispersion of a circular cut diamond. Additionally, it is another object of the present invention to produce a larger-looking diamond per unit volume as compared to the current standard Ideal Cut.

BRIEF SUMMARY OF THE INVENTION

In view of the foregoing disadvantages inherent in the current standard Ideal Cut, it is an object of the present invention to provide a diamond which constitutes a further improvement over what is known in the art. The present invention provides a diamond with improved characteristics of brilliance, scintillation and disperson while causing the least possible loss of gemstone material.

According to one aspect of the invention, a circular diamond is provided, comprising 57, or if counting the culet, 58 polished planar surfaces. Additionally, this aspect comprises a body with a girdle and a table parallel thereto, a bezel between the table and girdle and a pavilion below the general plane of the girdle. The principle geometric shape is made up of a lower conical shape, the pavilion, and an upper section with a frustum shape, the crown. The crown and pavilion are placed base to base. The juncture at the crown base to pavilion base forms a circular edge known as the girdle.

The novel features which are considered as characteristic for the invention are set forth in particular in the appended claims. The invention itself, both as to its construction and method of operation, together with additional objects and advantages thereof, will be best understood from the following detailed description of specific embodiments when read in connection with the accompanying drawings.

Figure 1:
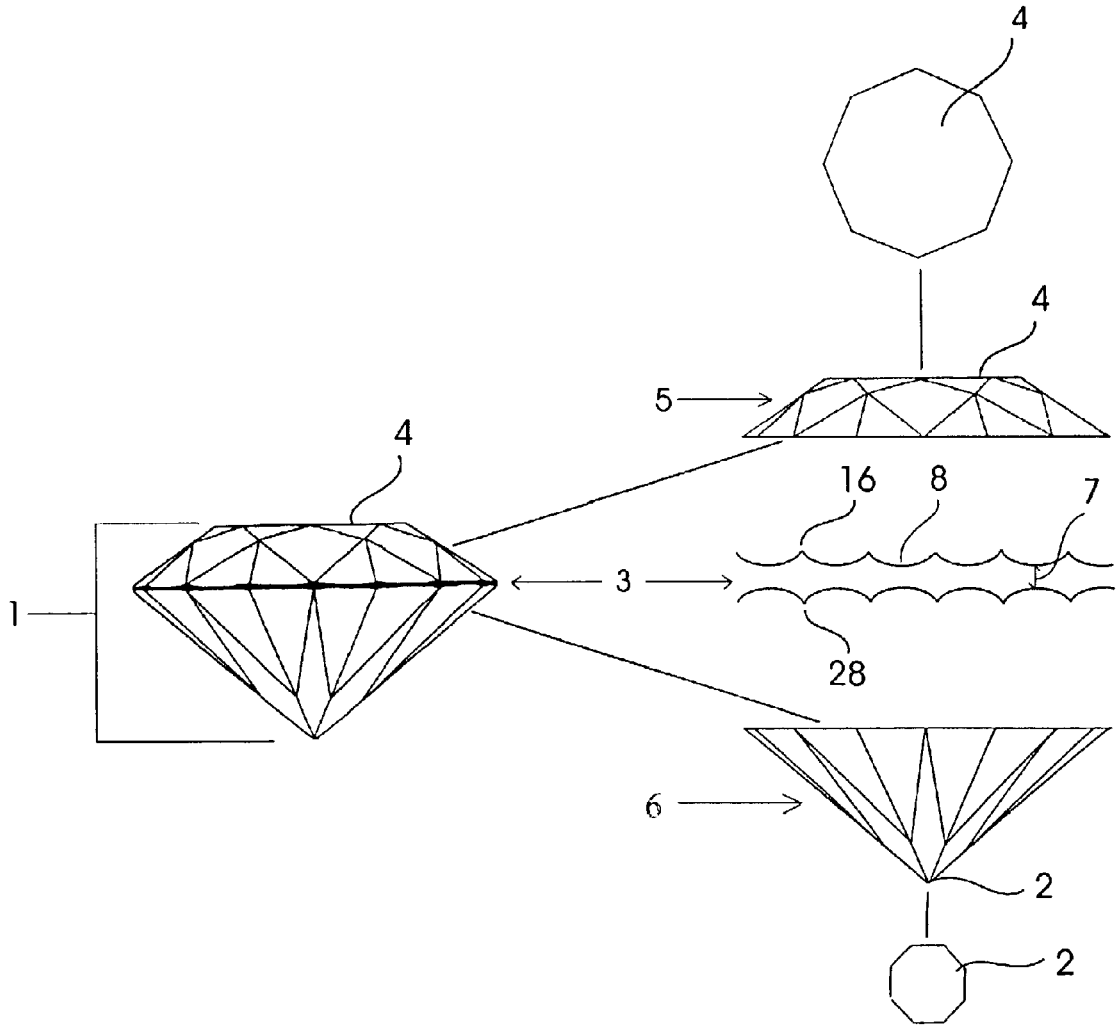
FIG. 1 is a side view of the present invention including more detailed representations of the girdle, pavilion, crown, table and culet.

| Reference Numerals in Drawings | |
|---|---|
| 1 | Circular cut diamond. |
| 2 | Culet |
| 3 | Girdle |
| 4 | Table |
| 5 | Crown |
| 6 | Pavilion |
| 7 | Location of girdle thickness measurement |
| 8 | Low point of the girdle's valley |
| 9 | Crown angle |
| 10 | Girdle plane |
| 11 | Upper bezel facet |
| 12 | Upper girdle facet |
| 13 | Upper girdle angle |
| 14 | Upper girdle facet junction |
| 15 | Surface distance (Crown) |
| 16 | Upper girdle edge |
| 17 | Table edge |

-continued

| Reference Numerals in Drawings | |
|---|---|
| 18 | Star facet |
| 19 | Star facet and upper girdle facet junction |
| 20 | Star facet length |
| 21 | Table diameter |
| 22 | Pavilion main facet |
| 23 | Pavilion angle |
| 24 | Lower girdle facet angle |
| 25 | Lower girdle facet |
| 26 | Lower girdle boundary |
| 27 | Surface distance (pavilion) |
| 28 | Lower girdle edge |
| 29 | Culet diameter |

DETAILED DESCRIPTION OF THE INVENTION

Referring to the drawings, different aspects of the invention are shown in FIGS. 1 through 5. According to one aspect of the invention as shown in FIG. 1, a circular diamond (1) is provided, comprising 57, or if counting the culet (2), 58 polished planar surfaces. Additionally, this aspect comprises a body with a girdle (3) and a table (4) substantually parallel thereto, a crown (5) between the table and girdle and a pavilion (6) below the general plane of the girdle. The principle geometric shape is made up of a lower conical shape, the pavilion (6), and an upper section with a frustum shape, the crow (5). The juncture where the crown meets the pavilion forms a circular edge known as the gridle (3). The girdle's thickness (7), measured at the low point of the girdle's valley (8), is one to three and one-half percent of the average girdle diameter, with the average girdle diameter being the mean of the maximum and minimum girdle diameter.

Figure 2:
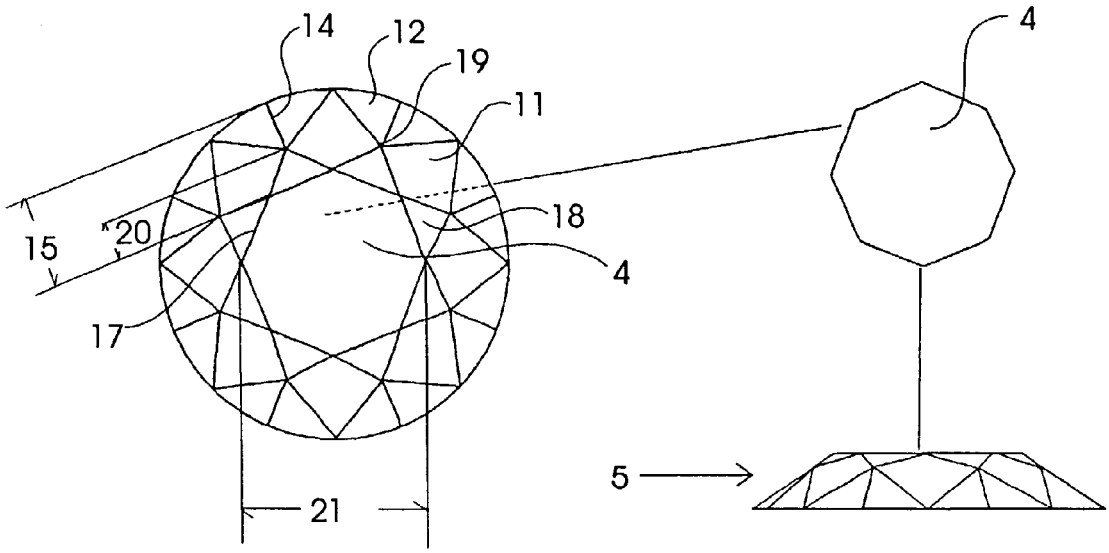
FIG. 2 is a top view of the present invention including more detailed representations of the crown and table.
Figure 3:
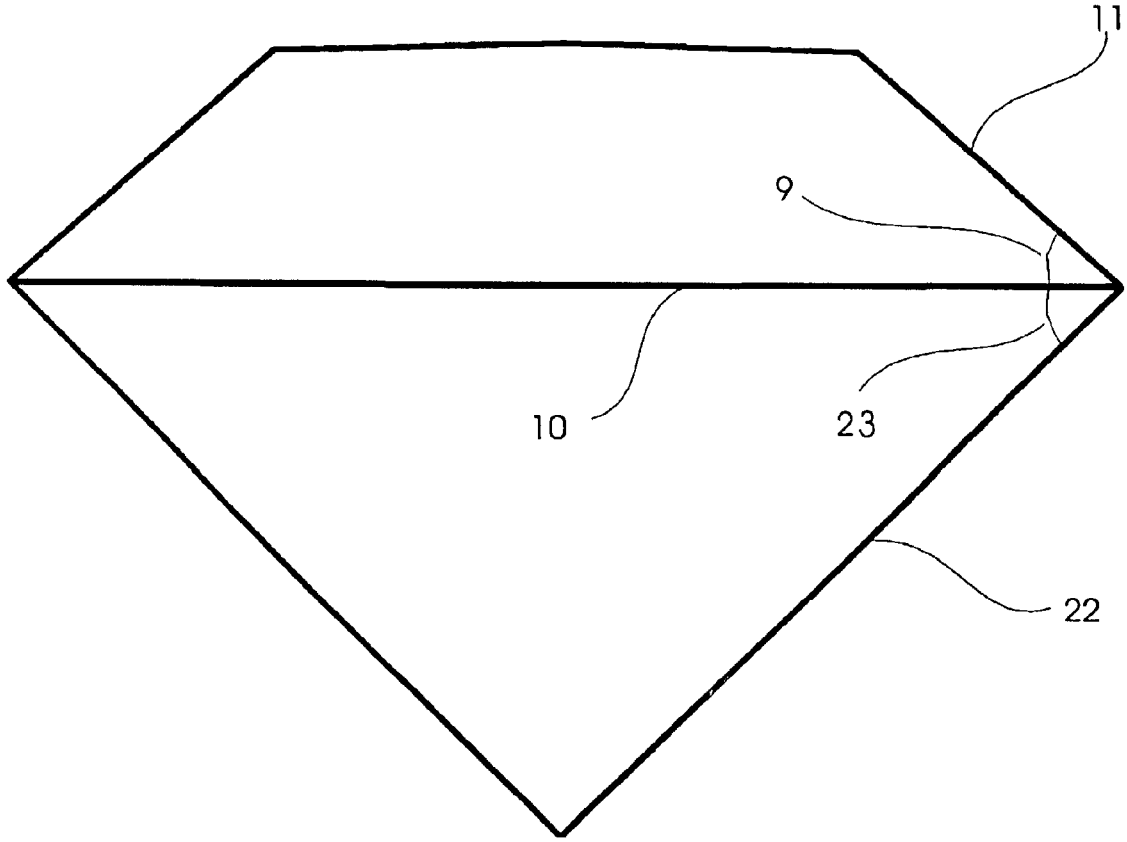
FIG. 3 shows a section of the present invention.
Figure 4:
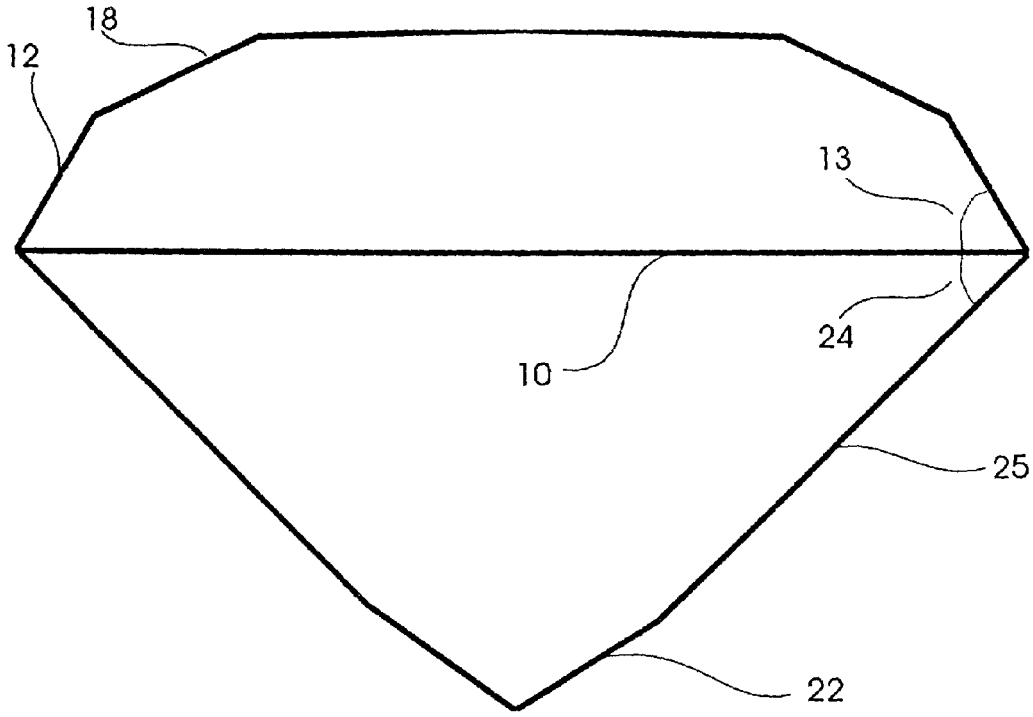
FIG. 4 shows a section of the present invention.

As shown FIG. 2, the crown contains 33 polished planar surfaces known as facets. As shown in FIGS. 2 and 3, eight substantially equally-spaced facets at angles (9) within the range of 23 to 30 degrees relative to the girdle plane (10) form the upper bezel facets (11). As shown in FIGS. 2 and 4, between these upper bezel facets and the girdle are 16 upper girdle facets (12) at angles (13) within the range of 27 to 39 degrees relative to the girdle plane. Each of the 16 upper girdle facets is immediately adjacent to, and forms a common triangle side boundary (14) with, another upper girdle facet and the length of the eight such common triangle side boundaries is 40 to 60 percent of the surface distance (15) measured from the upper girdle edge (16) to the table edge (17). Between the upper portion of the upper bezel facets are eight substantially triangular facets known as star facets (18) that are cut such that they meet the upper girdle facets substantially forming a point (19) where the five common facets meet. The star facet length (20), measured from the table edge to the point where the five common facets meet, must be within the range of 40 to 60 percent of the surface distance (15) from the table edge to the upper girdle edge. The one remaining facet above the girdle is the table (4). The table diameter (21) should be within the range of 52 to 60 percent of the average girdle diameter.

Figure 5:
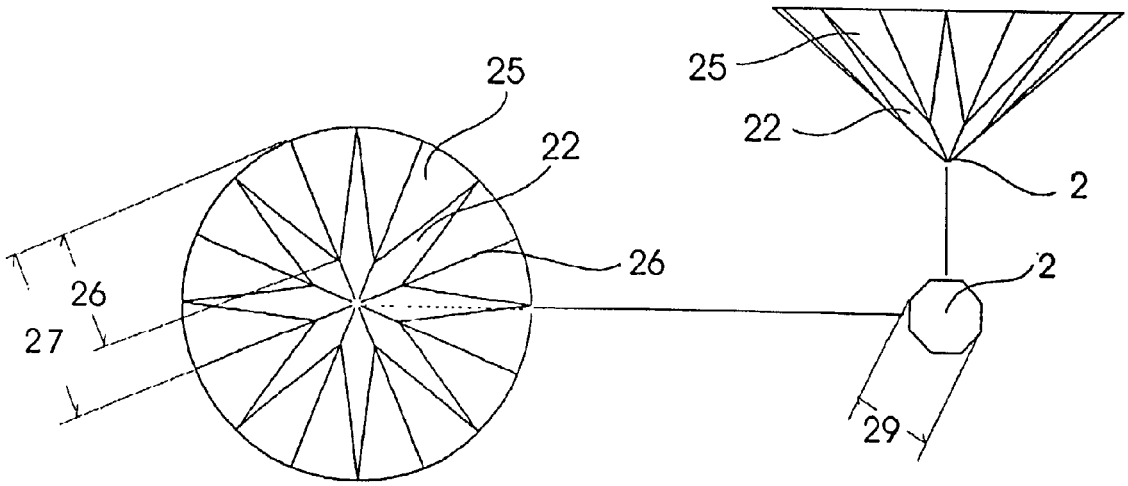
FIG. 5 shows a bottom view of the present invention including more detailed representations of the pavilion and culet.

As shown in FIGS. 3, 4 and 5, the pavilion consists of 24 facets, or 25 facets if a culet is used, including eight equally spaced pavilion main facets (22) placed at angles (23) within the range of 38.5 to 42 degrees relative to the girdle plane and aligned directly below the upper bezel facets. Between the pavilion main facets and at angles (24) within the range of 39.3 to 43.6 degrees relative to the girdle plane are 16 lower girdle facets (25). Each of the 16 lower girdle facets is immediately adjacent to, and forms a common triangle side boundary (26) with, another lower girdle facet and the length of the eight such common boundaries is 70 to 90 percent of the surface distance (27) measured from the lower girdle edge (28) to the point at the bottom of the pavilion or, if applicable, culet (2). If a culet is used, the culet diameter (29) must be not more than three percent of the average girdle diameter.

What is claimed is:

1. An improved circular-cut gemstone comprising:

a girdle with lower and upper girdle edges, a crown above said girdle, a substantially flat, octagon-shaped table located above the girdle wherein said girdle has a plane substantially parallel to the table, a pavilion located beneath the girdle and comprising a circumferential succession of pavilion facets wherein said pavilion has a bottom surface and said pavilion bottom surface consists of a point or culet, a bezel located above said girdle comprising a first annular region of upper bezel facets extending from said girdle towards said table, a second annular region of star facets, and a third annular region of upper girdle facets, wherein said girdle is substantially circular and has a diameter represented by the distance measured across said girdle plane from any first point on the girdle to a second point on the girdle wherein the second point on the girdle is 180 degrees from said first point on the girdle, wherein the pavilion facets include eight pavilion main facets and such pavilion main facets are angled at 40.7 to 42 degrees relative to the girdle plane, and wherein the upper bezel facets are angled 25 to 27 degrees relative to the girdle plane.

2. The gemstone according to claim 1, wherein the star facets have a length that is represented by the shortest distance measured along the star facet surface from a first point where two upper bezel facets, star facet, and two upper girdle facets meet to the closest point on the table and said star facet length is 48 to 55 percent of the distance represented by the measurement along the upper bezel facet surface from the point on said table where two star facets meet to the upper girdle edge.

3. The gemstone according to claim 2, wherein the pavilion facets include sixteen lower girdle facets and these lower girdle facets have a lower girdle facet length represented by the surface measurement of the common boundary between any two lower girdle facets and wherein said lower girdle facet length is 70 to 90 percent of the surface distance measured from any point on the lower girdle edge to said pavilion bottom.

4. The gemstone according to claim 3, wherein the table has a diameter which is represented by the distance measured across the table surface from the uppermost point of any first upper bezel facet to the uppermost point of a second upper bezel facet wherein the uppermost point of said second upper bezel facet is further from the uppermost point of said first upper bezel facet than any other uppermost point of the other upper bezel facets and wherein said table diameter is 54 to 60 percent of the girdle diameter.

5. The gemstone according to claim 4, wherein the upper girdle facets are angled 27 to 39 degrees relative to the girdle plane.

6. The gemstone according to claim 5, wherein the lower girdle facets are angled 39.3 to 43.6 degrees in reference to the girdle plane.

7. The gemstone according to claim 6, wherein the girdle has a minimum thickness represented by the shortest surface distance between the upper and lower girdle edges and said girdle minimum thickness is one to three and a half percent of the girdle diameter.

* * * * *

US006990833C1

(12) EX PARTE REEXAMINATION CERTIFICATE (7347th)

United States Patent

Smith

(10) Number: US 6,990,833 C1

(45) Certificate Issued: Feb. 2, 2010

(54) FACETED CIRCULAR CUT DIAMOND

(75) Inventor: Allen L. Smith, Albany, NY (US)

(73) Assignee: Robbins Bros. Corporation, Azusa, CA (US)

Reexamination Request:
No. 90/010,171, Jun. 6, 2008

Reexamination Certificate for:

| | |
|---|---|
| Patent No.: | **6,990,833** |
| Issued: | **Jan. 31, 2006** |
| Appl. No.: | **10/252,147** |
| Filed: | **Sep. 23, 2002** |

(51) Int. Cl.
*A44C 17/00* (2006.01)

(52) U.S. Cl. ..... 63/32; D11/89; D11/90

(58) Field of Classification Search ..... None
See application file for complete search history.

(56) References Cited

PUBLICATIONS

Modeling the Appearance of the Round Brilliant Cut Diamond: An Analysis of Fire, And More About Brilliance, Gems & Gemology, vol. 37, No. 3, pp. 174–197; publisher—Gemological Institute of America, Inc, Lawrence, Kansas.

*Primary Examiner*—Jeffrey L. Gellner

(57) ABSTRACT

A circular cut diamond, with appropriate dimensions, to greatly enhance the brilliancy, scintillation, and dispersion of a circular cut diamond and to produce a larger-looking diamond per unit volume as compared to the current standard Ideal Cut.

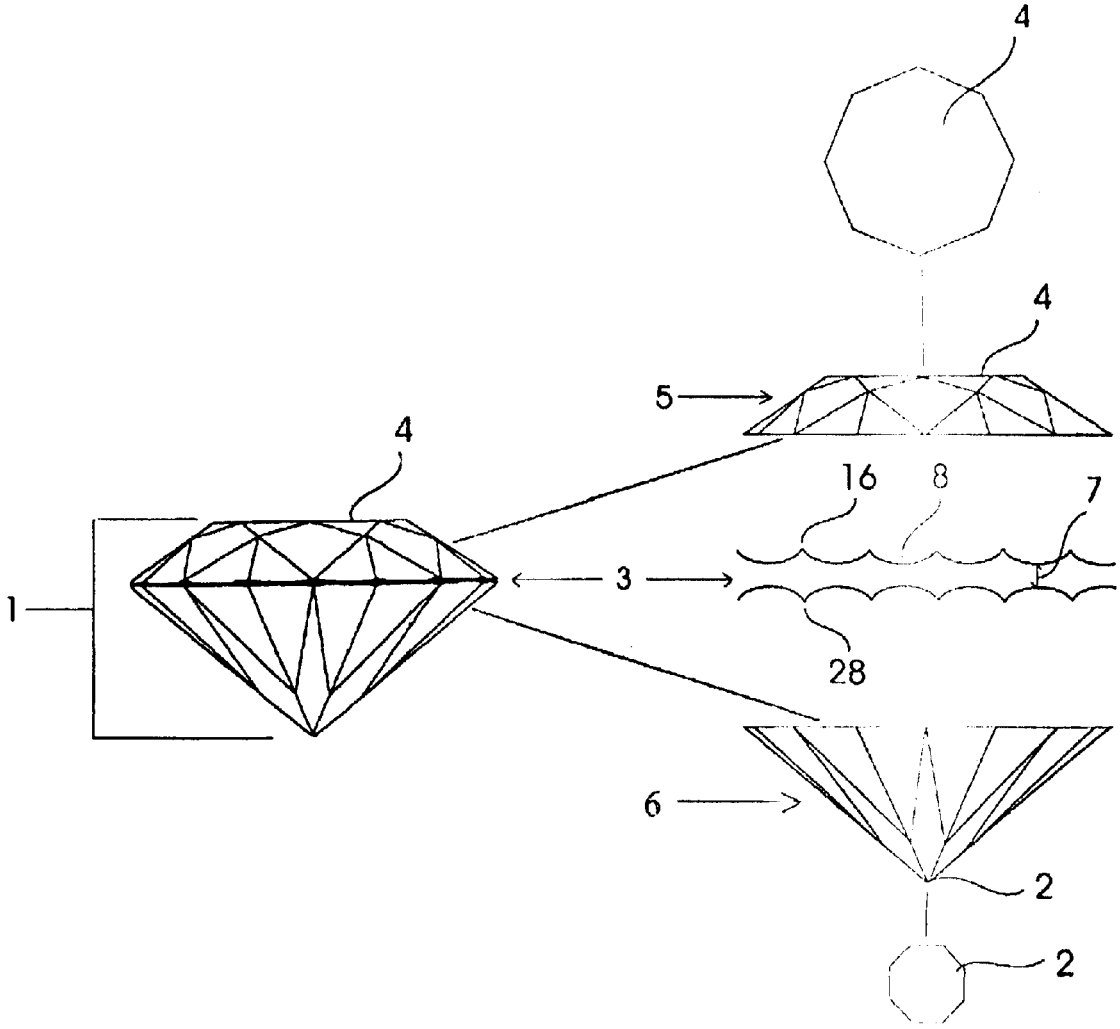

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 5 are cancelled.

Claims 2, 3, 4 and 6 are determined to be patentable as amended.

Claim 7, dependent on an amended claim, is determined to be patentable.

2. The gemstone according to claim [1] *6*, wherein the star facets have a length that is represented by the shortest distance measured along the star facet surface from a first point where two upper bezel facets, star facet, and two upper girdle facets meet to the closest point on the table and said star facet length is 48 to 55 percent of the distance represented by the measurement along the upper bezel facet surface from the point on said table where two star facets meet to the upper girdle edge.

3. The gemstone according to claim [2] *6*, wherein the pavilion facets include sixteen lower girdle facets and these lower girdle facets have a lower girdle facet length represented by the surface measurement of the common boundary between any two lower girdle facets and wherein said lower girdle facet length is 70 to 90 percent of the surface distance measured from any point on the lower girdle edge to said pavilion bottom.

4. The gemstone according to claim [3] *6*, wherein the table has a diameter which is represented by the distance measured across the table surface from the uppermost point of any first upper bezel facet to the uppermost point of a second upper bezel facet wherein the uppermost point of said second upper bezel facet is further from the uppermost point of said first upper bezel facet than any other uppermost point of the other upper bezel facets and wherein said table diameter is 54 to 60 percent of the girdle diameter.

6. [The gemstone according to claim 5] *An improved circular-cut gemstone comprising:*

*a girdle with lower and upper girdle edges;*

*a crown above said girdle;*

*a substantially flat, octagon-shaped table located above the girdle wherein said girdle has a plane substantially parallel to the table;*

*a pavilion located beneath the girdle and comprising a circumferential succession of pavilion facets wherein said pavilion has a bottom surface and said pavilion bottom surface consists of a point or culet;*

*a bezel located above said girdle comprising a first annular region of upper bezel facets extending from said girdle towards said table, a second annular region of star facets, and a third annular region of upper girdle facets;*

*wherein said girdle is substantially circular and has a diameter represented by the distance measured across said girdle plane from any first point on the girdle to a second point on the girdle wherein the second point on the girdle is 180 degrees from said first point on the girdle;*

*wherein the pavilion facets include eight pavilion main facets and such pavilion main facets are angled at 40.7 to 42 degrees relative to the girdle plane;*

*wherein the upper bezel facets are angled 25 to 27 degrees relative to the girdle plane;*

*wherein the upper girdle facets are angled 27 to 39 degrees relative to the girdle plane; and* wherein the lower girdle facets are angled 39.3 to 43.6 degrees in reference to the girdle plane.

* * * * *